US005286925A

United States Patent [19]

Cabaraux

[11] Patent Number: 5,286,925

[45] Date of Patent: Feb. 15, 1994

[54] ELECTRICAL CONDUCTOR, PROCESS FOR MANUFACTURING AN ELECTRICAL CONDUCTOR AND ELECTRODE FOR AN ELECTROLYSIS CELL

[75] Inventors: Emile Cabaraux, Brussels, Belgium; Edgard Nicolas, Rosignano, Italy

[73] Assignee: Solvay (Societe Annonyme), Brussels, Belgium

[21] Appl. No.: 866,759

[22] Filed: Apr. 10, 1992

[30] Foreign Application Priority Data

Apr. 18, 1991 [BE] Belgium ..... 09100361

[51] Int. Cl.[5] ..... H01B 5/00

[52] U.S. Cl. ..... 174/126.2; 156/50; 156/51; 204/280; 219/56; 219/118

[58] Field of Search ..... 174/126, 2; 219/137 WM, 219/118, 56; 156/50, 51; 204/280, 288, 290 R

[56] References Cited

U.S. PATENT DOCUMENTS

| | | | |
|---|---|---|---|
| Re. 32,078 | 2/1986 | Woodard, Jr. et al. | 204/252 |
| 2,985,747 | 3/1961 | Kutchera | 219/137 WM |
| 3,511,646 | 3/1970 | Von Scheek et al. | 219/137 WM |
| 4,014,763 | 3/1977 | Lome | 204/106 |
| 4,196,335 | 4/1980 | Ikeda et al. | 219/137 WM X |
| 4,269,687 | 5/1981 | Gilbert et al. | 204/242 |
| 4,452,685 | 6/1984 | Woodard, Jr. et al. | 204/252 |
| 4,460,450 | 7/1984 | Koziol et al. | 204/290 F |
| 4,647,358 | 3/1987 | Bartsch et al. | 204/286 |

FOREIGN PATENT DOCUMENTS

| | | |
|---|---|---|
| 89475 | 2/1983 | European Pat. Off. . |
| 125083 | 4/1984 | European Pat. Off. . |
| 2550178 | 5/1976 | Fed. Rep. of Germany . |
| 1460090 | 12/1976 | United Kingdom . |
| 2041002 | 9/1980 | United Kingdom . |

*Primary Examiner*—Morris H. Nimmo

*Attorney, Agent, or Firm*—Emmanuel J. Lobato; Robert E. Burns

[57] ABSTRACT

Electrical conductor comprising a metallic bar (1) jacketed with a sheath (2) made from a metal different from that of the bar, in which the bar (1) exhibits at least one longitudinal groove (3, 3') containing a bead (4, 4') made from the same metal as the sheath (2), welded to the bar (1), and the sheath (2) exhibits an opening opposite the bead (4, 4'), the said opening containing a metallic mass (9, 9') welded to the bead (4, 4') and to the sheath (2). The conductor finds one application in electrodes comprising a metallic plate longitudinally fixed to an electrical conductor.

12 Claims, 3 Drawing Sheets

ELECTRICAL CONDUCTOR, PROCESS FOR MANUFACTURING AN ELECTRICAL CONDUCTOR AND ELECTRODE FOR AN ELECTROLYSIS CELL

The present invention relates to an electrical conductor comprising a metallic bar jacketed with a sheath made from a metal different from that of the bar.

Electrical conductors of this type are commonly used in the construction of electrodes intended for cells for the electrolysis of aqueous solutions, especially of sodium chloride solutions. In this application, they usually comprise a copper bar jacketed with a sheath made from a metal which is inert with respect to the chemical environment in the electrolysis cell, and they are inserted horizontally or vertically between a pair of vertical metallic plates forming the actual electrode. For example, in the case of cathodes intended for the electrolytic production of hydrogen and aqueous sodium hydroxide solutions, the metal of the sheath is generally chosen from iron, nickel and their alloys. The copper bar is used for its high electrical conductivity and consequently has the principal function of conveying high current densities, whereas the sheath serves to isolate the copper bar from the corrosive action of the electrolytes flowing in the electrolysis cell. The sheath furthermore provides the additional function of ensuring that the electrical current flows between the bar and the electrode plates. It is consequently desirable to reduce to a minimum the electrical contact resistance between the bar and the sheath. In order to achieve this objective, consideration has been given to using electrical conductors obtained by a metallurgical operation of coextrusion of the bar and the sheath. However, electrical conductors obtained by this technique are expensive.

In U.S. Pat. No. 4,647,358, a more economical process is proposed for manufacturing an electrical conductor intended for the electrolytic refining of copper. According to this process, the copper bar and the sheath are manufactured separately, the latter being slit over its entire length, the bar is inserted into the sheath and the edges of the slit of the sheath are welded to each other. However, electrical conductors obtained by this known process have a very poor electrical conductivity at the contact surface between the bar and the sheath.

The invention aims to overcome the abovementioned drawbacks by providing an electrical conductor formed from a bar jacketed with a sheath, which has a good electrical conductivity in the contact zone between the bar and the sheath and which is simple and economical to manufacture.

Accordingly, the invention relates to an electrical conductor comprising a metallic bar jacketed with a sheath made from a metal different from that of the bar; according to the invention, the bar exhibits at least one longitudinal groove containing a bead made from the same metal as the sheath, welded to the bar, and the sheath exhibits an opening opposite the bead, the said opening containing a metallic mass welded to the bead and to the sheath.

In the electrical conductor according to the invention, the metallic bar has the principal function of conducting the electrical current. The sheath fulfills two functions: on the one hand, it serves to isolate the bar from the chemical environment in which the electrical conductor is used; on the other hand, it serves to transfer the electrical current in the direction transverse to the bar between the latter and a metallic element (for example an electrode) connected to the sheath.

The profile of the bar is not critical. It may, for example, consist of a cylinder of circular or oval cross-section, or of an elongate parallelepiped the cross-section of which is a square, a rectangle, a trapezium or any other polygon, regular or otherwise. For ease of construction, a rectilinear bar of square or rectangular cross-section is preferably used. According to the invention, the bar has a longitudinal groove. The latter may extend over the total length of the bar or over only a fraction of the latter. The groove serves as receptacle for a metallic bead constituted by the same metal or alloy as the sheath, this metallic bead being welded to the bar.

The sheath must have a profile which is matched to the profile of the bar in such a manner that it can envelope it over approximately its total length. The profile of the sheath and its disposition around the bar must furthermore be such that the sheath has an opening opposite the metallic bead which is in the groove of the bar. The opening of the sheath may be a slot which extends over its total length or over only a portion of the latter. It serves as a receptacle for a metallic mass constituted by the same metal or alloy as the sheath, this metallic mass being welded to the bead and to the sheath.

The metal of the sheath depends on the intended use of the electrical conductor. It must be chosen from those metals capable of being welded to the metal of the bar.

In a particular embodiment of the electrical conductor according to the invention, the metallic bar is made from copper and the sheath is made from a metal chosen from iron, nickel, alloys of iron and alloys of nickel. The alloys of iron comprise ordinary carbon steels and alloyed steels such as, for example, stainless steels alloyed with chromium, nickel and molybdenum and steels alloyed with silicon which have special electrical properties. Examples of nickel alloys are Monel (alloy of nickel, copper, iron, manganese and silicon) and Inconel (alloy of nickel, manganese, iron, silicon, chromium, aluminium and titanium). The electrical conductors in accordance with this embodiment of the invention find particular application in the construction of cathodes intended for cells for electrolysis of aqueous alkali metal chloride solutions.

In another embodiment of the electrical conductor according to the invention, the sheath is a metallic sheet folded around the bar in such a manner as to envelope the latter, and the abovementioned opening is a slot delimited between the two juxtaposed edges of the sheet.

In a further embodiment of the electrical conductor according to the invention, the bar has two longitudinal grooves containing a bead made from the same metal as the sheath, and the sheath is formed from two separate trough-shaped longitudinal shells which longitudinally cover the bar while providing, between their longitudinal edges which face each other, a gap constituting the abovementioned opening opposite each bead. In this embodiment of the invention, the sheath consequently has two slot-shaped longitudinal openings which are located facing the beads and which contain two metallic masses such as defined above, welded respectively to the two beads and to the two shells.

In the electrical conductor according to the invention, the bar is coupled to the sheath by a welded assembly, constituted by the abovementioned bead or beads and by the abovementioned metallic mass or masses. This welded assembly ensures an optimum electrical connection between the bar and the sheath and, as a consequence, reduces the resistance to the passage of the electrical current between the bar and the sheath.

The invention also relates to a process for manufacturing an electrical conductor, by assembling a metallic bar and a sheath made from a metal different from that of the bar; according to the invention at least one longitudinal groove is made in the bar, a bead made from the same metal as the sheath is welded in the groove of the bar, the bar is inserted into the sheath by making an opening in the latter opposite the bead and the sheath is welded to the bead in the abovementioned opening.

In the process according to the invention, the bar may be obtained, for example, by a metallurgical rolling operation. The groove may be formed in the bar during the rolling, or alternatively it may be formed subsequently by a machining operation.

The sheath may be obtained by a rolling operation of the type which are used for the manufacture of metallic tubes, the abovementioned opening in the sheath then being obtained by machining. However, according to the invention, it is preferred to utilise a sheath obtained by folding or roll-bending a metallic sheet. For this purpose, in a particular embodiment of the process according to the invention, a sheath obtained by roll-bending or folding a metallic sheet is utilised and a gap forming the abovementioned opening, intended to contain the metallic mass, is left between the longitudinal edges of the roll-bent sheet.

In another embodiment of the process according to the invention, two longitudinal grooves are made in the bar and a sheath obtained by placing the two longitudinal metallic shells together in such a manner as to leave a gap between their opposingly disposed edges, the said spacing forming the abovementioned opening. In this embodiment of the process according to the invention, the two shells have the shape of a trough and are obtained, for example, by deep-drawing a metallic sheet.

The electrical conductor according to the invention is especially designed for the transport of the electrical current longitudinally in the bar and transversely through the sheath. It is suitable both for direct current and for alternating current. It finds one advantageous application in the construction of electrodes intended for electrolysis processes, such as iron, steel or nickel cathodes which are commonly used in processes for the electrolysis of water or of aqueous alkali-metal chloride solutions.

The invention consequently also relates to an electrode for an electrolysis cell, comprising at least one plate made from a metal selected from iron, nickel, alloys of iron and alloys of nickel, the said plate being fixed to an electrical conductor according to the invention, in which the bar is made from copper and the sheath is made from a same metal as the plate. This electrode finds one application as a cathode for the production of hydrogen and of aqueous sodium hydroxide solutions in a cell for the electrolysis of aqueous sodium chloride solutions.

In the electrode according to the invention, the plate may be solid or perforated. It may, for example, be a sheet made from expanded metal.

Particular features and details of the invention will emerge from the following description of the attached drawings, which show several embodiments of the electrical conductor and of the electrode according to the invention.

In these figures, the same reference notations designate identical elements.

Figure 1:
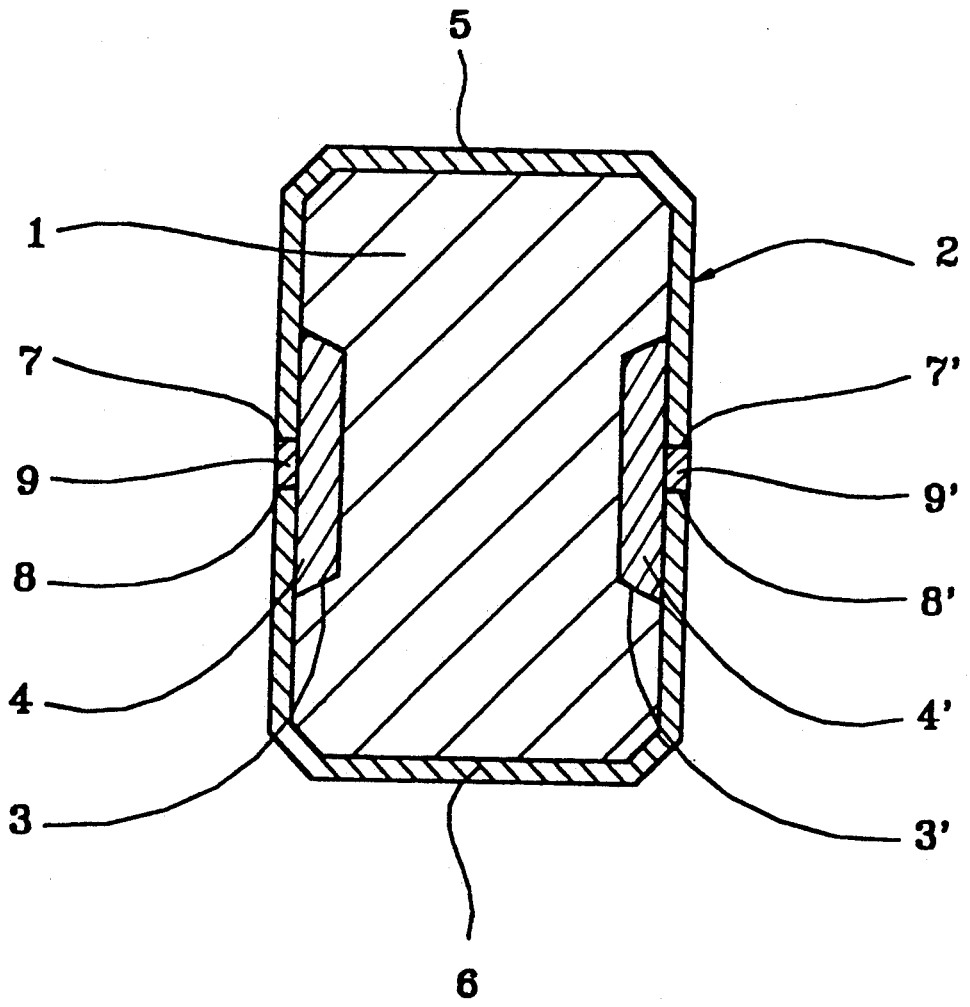
FIG. 1 shows, in cross-section, a particular embodiment of the electrical conductor according to the invention.

The electrical conductor represented in FIG. 1 comprises a bar 1 made from copper, in a sheath 2 made from nickel. The copper bar is a rectilinear bar, of rectangular cross-section, which has been obtained by rolling. It exhibits, on two opposite faces, two grooves 3, 3'. The grooves 3 and 3' are filled with nickel beads 4 and 4'. The nickel beads have been formed in the grooves by deposition in the molten state by means of a conventional arc-welding technique using a nickel or nickel-alloy welding rod, such that they are welded to the bar 1.

The sheath 2 is constituted by two shells 5 and 6 having the shape of troughs matching exactly the perimeter of the bar 1. The shells 5 and 6 have been obtained by deep-drawing two nickel sheets. Their sizes are chosen in such a manner that a slot is delimited by their longitudinal edges 7 and 8 opposite the bead 4 and such that a second slot is delimited between their other longitudinal edges 7' and 8' opposite the bead 4'. These two slots are filled respectively with two nickel masses 9 and 9'. The latter are obtained by deposition from the molten state by means of a conventional arc-welding technique using a nickel or nickel-alloy welding rod, such that they are welded to the beads 4, 4' and to the shells 5 and 6.

In the conductor represented in FIG. 1, the beads 4 and 4' and the metallic masses 9 and 9' produce both a mechanical fixing of the sheath 2 to the bar 1 and a low-resistance electrical connection between the bar 1 and the sheath 2.

Figure 2:
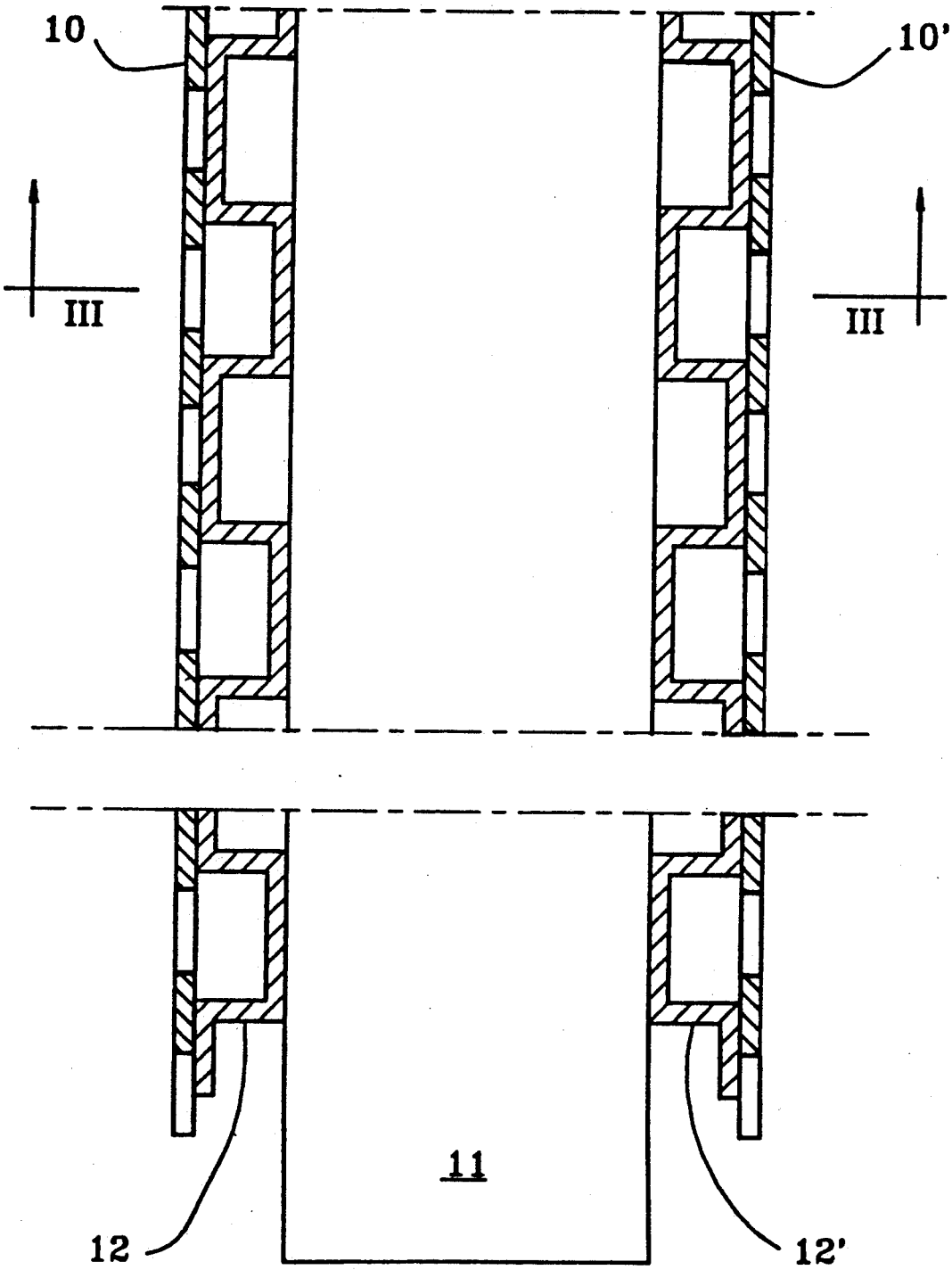
FIG. 2 shows a particular embodiment of the electrode according to the invention, in cross-section in the horizontal plane II—II of FIG. 3.
Figure 3:
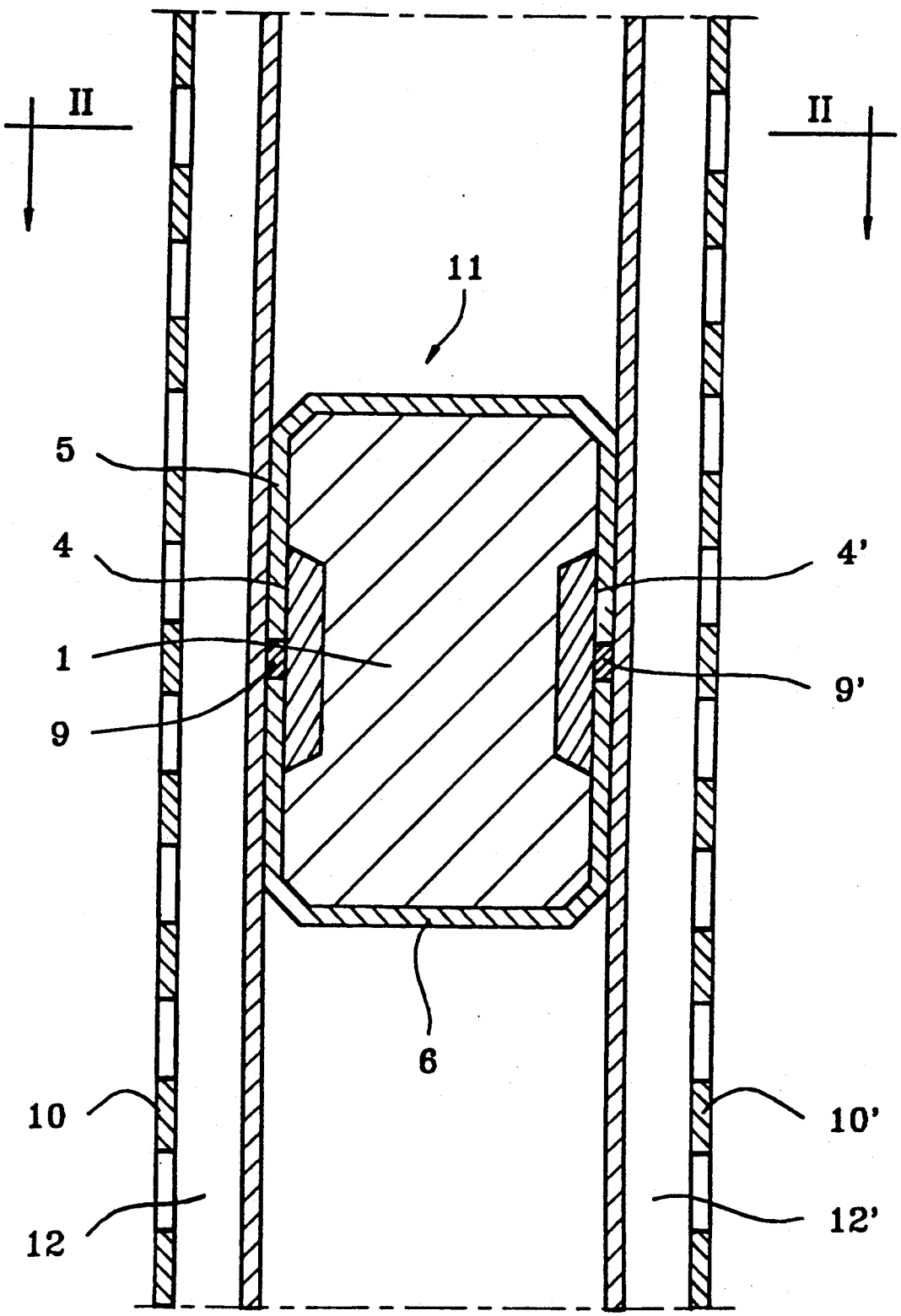
FIG. 3 is a vertical cross-section in the plane III—III of FIG. 2.

The electrode represented in FIGS. 2 and 3 comprises a pair of perforated vertical nickel plates 10, 10', disposed in a parallel fashion and opposite each other, on either side of a horizontal metallic conductor designated in its entirety by the reference notation 11. Two corrugated nickel sheet elements 12, 12' serve to connect the plates 10 and 10' to the conductor 11.

The conductor 11 conforms to that shown in FIG. 1 and described above.

The plates 10 and 10' are fixed to the sheet elements 12 and 12' by weld points.

The sheet elements 12 and 12' are also fixed by a welding operation. The latter is carried out all along the metallic masses 9 and 9' of the electrical conductor, in such a manner as to minimise the electrical resistance of the connection between the plates 10, 10' and the bar 1 of the electrical conductor 11.

I claim:

1. An electrical conductor comprising; an electrically conductive metallic bar;

a sheath jacketing said metallic bar and made of a metal different from that of said metallic bar;

said metallic bar having at least one longitudinal groove containing a metallic weld bead made of a metal the same as the metal of said sheath and welded to the bar;

said sheath having an opening opposite said weld bead in registry therewith; and said opening containing a metallic weld mass welded to said weld bead and to said sheath.

2. An electrical conductor according to claim 1, in which said longitudinal groove extends along an entire length of said bar.

3. An electrical conductor according to claim 1, in which said bar is made of copper; and in which said sheath is made of a metal selected from the group iron, copper, nickel, alloys of iron and alloys of nickel.

4. An electrical conductor comprising;

an electrically conductive metallic bar;

a sheath jacketing said metallic bar and made of a metal different from that of said metallic bar;

said metallic bar having two longitudinal grooves on opposite sides thereof each containing a metallic weld bead made of a metal the same as the metal of said sheath and each weld bead welded to said bar;

said sheath constituting two separate elongated shells disposed longitudinally covering said metallic bar and each having longitudinal edges disposed when covering said bar facing each other spaced defining two longitudinal gaps between the shells on opposite sides of said metallic bar each in registry with a corresponding said metallic weld bead; and each said gap containing a metallic weld mass welded to a respective weld bead and to the metallic shells constituting said sheath.

5. An electrical conductor according to claim 4, in which said two longitudinal grooves extend along an entire length of said bar.

6. An electrical conductor according to claim 4, in which said bar is made of copper; and in which said sheath shells are made of a metal selected from the group iron, copper, nickel, alloys of iron and alloys of nickel.

7. A method of manufacturing an electric conductor comprising;

making an electrically conductive metallic bar having at least one longitudinal groove along at least a length thereof and making an elongated metallic sheath for jacketing the metallic bar;

welding in said groove a length of metallic weld bead of a same metal as said metallic sheath;

jacketing the bar with said metallic sheath by covering said bar extending longitudinally therein with said sheath having a longitudinal opening opposite to said weld bead; and welding a length of a mass of weld metal to said weld bead on the bar through said longitudinal opening and at the same time welding said mass of weld metal to said sheath, thereby assembling the bar and jacketing sheath in fixed assembly.

8. A method of manufacturing an electrical conductor according to claim 7, in which said sheath is made of a metal selected from the group iron, nickel, alloys of iron and alloys of nickel, and in which said length of a mass of weld metal is a same identical metal selected from said group for said sheath.

9. A method of manufacturing an electrical conductor according to claim 8, in which said electrically conductive metallic bar is made of copper.

10. A method of manufacturing an electrical conductor comprising;

making a metallic bar with two longitudinal grooves extending on opposite sides of said bar and two metallic sheath shells made of a same metal which is different than the metal of said bar for jacketing said bar with said sheath shells defining a metallic sheath covering said bar;

welding in each of said grooves a respective weld bead made of a same metal as said sheath shells;

jacketing the bar with said metallic sheath shells by covering the bar with the two sheath shells disposed longitudinally over said bar oppositely disposed with said bar extending longitudinally therein;

said two sheath shells having longitudinal side edges disposed spaced facing each other defining two longitudinal gaps therebetween on opposite sides of said bar when disposed jacketing the bar; and welding to each weld bead on the bar a respective length of a mass of weld metal through said longitudinal gaps and at the time of said welding to each weld bead welding each said respective length of a mass of weld metal to said sheath shells, thereby assembling the bar and sheath shells in fixed assembly.

11. A method of manufacturing an electrical conductor according to claim 10, in which said sheath shells are made of a metal selected from the group iron, nickel, alloys of iron and alloys of nickel, and in which said length of a mass of weld metal is a same identical metal selected from said group for said sheath shells.

12. A method of manufacturing an electrical conductor according to claim 11, in which said electrical conductive metal bar is made of copper.

* * * * *